US005133413A

United States Patent [19]

Baxter

[11] Patent Number: 5,133,413

[45] Date of Patent: Jul. 28, 1992

[54] BEACH CLEANING APPARATUS

[76] Inventor: Randall K. Baxter, 403 E. Pecan St., San Saba, Tex. 76877

[21] Appl. No.: 472,345

[22] Filed: Jan. 30, 1990

[51] Int. Cl.[5] ..... E01H 1/04

[52] U.S. Cl. ..... 171/63; 171/85; 15/84; 56/364

[58] Field of Search ..... 171/7, 63, 84, 86, 93, 171/95, 98, 107, 130, 85; 172/30, 33, 122, 123, 519, 540, 543, 554; 56/400, 364, 344, 12.4, 12.5; 15/82, 83, 84, 78

[56] References Cited

U.S. PATENT DOCUMENTS

| | | | |
|---|---|---|---|
| 469,030 | 2/1892 | Newlove | 15/84 |
| 685,352 | 10/1901 | Schunicht | 171/116 |
| 881,323 | 3/1908 | Long | 15/84 |
| 2,296,851 | 9/1942 | Henry | 171/9 |
| 2,652,673 | 9/1953 | Zehren | 171/63 |
| 2,856,013 | 10/1958 | Evans | 171/9 |
| 3,777,327 | 12/1973 | Ellis | 15/84 |
| 4,434,011 | 2/1984 | Moore | 15/78 X |
| 4,482,019 | 11/1984 | Murphy | 171/63 |
| 4,550,465 | 11/1985 | Chrisley | 171/63 X |
| 4,603,544 | 8/1986 | Hayhurst | 172/554 X |
| 4,809,380 | 3/1989 | Van Ginhoven et al. | 56/364 X |
| 4,842,076 | 6/1989 | Welp | 171/130 X |

FOREIGN PATENT DOCUMENTS

| | | | |
|---|---|---|---|
| 53679 | 9/1937 | Denmark | 171/130 |
| 1217676 | 5/1966 | Fed. Rep. of Germany | 171/63 |

*Primary Examiner*—Randolph A. Reese
*Assistant Examiner*—Jeffrey L. Thompson
*Attorney, Agent, or Firm*—Donald R. Comuzzi

[57] ABSTRACT

An apparatus for picking litter off sandy beaches with minimal sifting of sand. A rotary drum, with unique rigid protrusions and non-rigid projections, is independently powered to roll in the opposite direction as the moving apparatus. The protrusions on the drum dig into the subsurface of sandy beaches and bring up debris that may be lodged in the sand, while the projections toss debris on the surface into the apparatus for collection.

11 Claims, 2 Drawing Sheets

BEACH CLEANING APPARATUS

BACKGROUND OF THE INVENTION

This invention relates to cleaning equipment used on land surfaces, and more particularly but not by way of limitation to apparatus for picking litter and other debris off sand beaches. Beaches attract fun-seekers and vacationers and, with them, disposable items which are left scattered on the shoreline, often embedded in the sand. The tides also bring in undesirable, unsightly flotsam and debris which, together with artificial trash, have to be picked up.

The major difficulty encountered in cleaning litter off beaches with machines is picking up the garbage without hauling off large volumes of sand and water. Several attempts have been made in the past to produce machines that can efficiently remove debris without removing sand. The present invention is a vast improvement over these previous attempts. For instance, U.S. Pat. No. 2,488,774 issued to Hassan discloses a beach cleaning machine which has excavating buckets mounted onto a rotating drum. The buckets are designed to scoop up large amounts of sand which are then sifted on an inclined screen. This design would be inefficient and time consuming in practical application since much of the effort will be directed to filtering bulk sand.

U.S. Pat. No. 2,744,739 issued to Evans et al. discloses a beach cleaning device which has the same basic design as Hassan '774, except for elongated blades which are mounted along the length of a rotating drum instead of excavating buckets. Both Hassan '774 and Evans '739 are designed to scoop large amounts of sand which is then filtered for litter and sand allowed to return to the beach. U.S. Pat. No. 2,733,904 issued to Gauther et al. discloses a beach cleaner which utilizes an adjustable shovel and a paddle wheel. The shovel is lowered onto sand and forward movement of the entire machine combined with help from the paddle wheel pushes sand into the shovel and onto a sieve net.

In sum, prior art discloses drums which are dragged along the sand in the same forward direction as the powered vehicle which mounts or tows the drum. Prior art designs focus on lifting large bulks of sand containing litter upward onto screens for subsequent straining.

The present invention discloses an apparatus which can actually pick litter off a sandy beach without having to scoop upward bulk sand, avoiding needless effort and delay. Thus, an object of the present invention is to efficiently clean litter off beaches with minimal sifting of sand. This is accomplished using unique projections and protrusions on a rotary drum that is independently powered to roll in the opposite direction as the moving apparatus. Another object of the present invention is to dig into the subsurface of sandy beaches to bring to surface debris that may be lodged in the sand. These and other improvements will become evident to those skilled in the art in the following disclosure.

SUMMARY OF THE INVENTION

The present invention discretely lifts debris off the surface of sandy beaches using a plurality of resilient, non-rigid projections protruding out of a rotary drum. As the apparatus moves forward over a beach surface, the drum rotates in the opposite direction powered by a drive means. The rotation of the drum compresses non-rigid projections which press against the sand surface.

As the drum further rotates, weight is lifted off the resilient projections. With release of compressive weight, the projections regain their shape and this metamorphosis "flicks" rearwardly any litter that lies in their path. The rearward flicking motion tosses the debris onto a perforated, endless conveyor belt.

At predetermined intervals, the rotary drum, additionally, has a plurality of rigid protrusions, separate and distinct from the non-rigid projections. As the drum rotates, the rigid protrusions dig below the surface and bring up litter lodged in the sand. Once brought to surface, the non-rigid projections toss the excavated litter onto the perforated endless conveyor belt.

In the preferred embodiment, the resilient, non-rigid projections are made of a suitable rubber material and the rigid protrusions are comprised of metal tine. One skilled in the art could easily substitute other resilient materials suitable for the former and other suitable rigid materials for the latter and obtain substantially similar results.

The perforated conveyor belt performs two functions. The first is to carry trash toward an intermediate trash collector or trough. The second function is to sift any sand that may have been brought up along with tossed debris. Sand by nature has a tendency to cling onto debris and this physical aspect prevents total separation of sand from trash even with the tossing action. However, on the conveyor belt, much of the sand adhered to the surface of the debris does come off and falls back onto the beach through the perforations in the conveyor belt.

In the preferred embodiment, there are two conveyor belts, the first substantially wider than the second. The first conveyor belt has one end adjacent the length of the rotating drum, and an opposite end, astern and adjacent the collecting trough. Both conveyor belts are comprised of mesh screen which creates abundant perforations through which sand and water can easily drip through. A skilled artisan could easily substitute other perforated materials for the belt to create an endless conveyor and a separator of sand from debris.

The first conveyor belt carries debris towards the intermediate collecting trough. Within the trough, a screw conveyor agitates the debris further loosening any sand that may have overcome the hurdle of the first conveyor belt. The bottom of the trough has linear, perforated striations through which any loosened sand and extraneous water falls through. Additionally, rotational movement of the screw conveyor pushes the debris onto the second endless conveyor belt. In the preferred embodiment, the second conveyor belt is much narrower than the first, and is located on one lateral side of the apparatus (either port or starboard). This second belt moves debris toward a main trash storage bin. In transit, sand loosened by the screw conveyor in the trough filters through perforations in the the second conveyor belt.

In the preferred embodiment, the main storage bin is a hopper with a curved floors. A hinged screw auger is positioned in the upper portion of the hopper on the same lateral side as the second conveyor belt. As debris leaves the second conveyor belt and moves into the hopper, the auger urges the debris towards the opposite side avoiding unbalanced piling or overflow. The curved floor is comprised of expanded metal which allows final filtration of any sand that may have reached that far and drains any moisture that may collect in the hopper. Finally, when the hopper is full, hydraulic means mounted externally lifts the hopper and tips it over allowing collected debris to fall into a dump site or an independent collecting vehicle to be hauled away to a distant dump site. The screw auger within the hopper hinges freely from the interior of the bin so that dumping is not hindered.

The entire invention is primarily designed to operate as a trailer towed by a powered vehicle such as a tractor, but one embodiment is self-propelled. In the preferred embodiment, the apparatus is mounted onto a trailer frame which has two vehicular wheels located substantially midway from aft to stern. The wheels are not powered and rotate with the forward movement of the apparatus. Beginning at the forwardmost portion of the trailer, a hitch assembly allows connection to a powered vehicle which pulls the trailer. In one embodiment, a drive shaft extends from a tractor to the trailer forming a drive train which powers the rotating drum through a series of chains mounted on sprockets. This drive train also powers the rotation of both endless conveyor belts through another series of chains mounted on sprockets.

As the trailer is pulled forward by the tractor, the drive train is designed to rotate the drum and the first conveyor belt in a rotational direction opposite the forward direction of the trailer. This allows the drum to "flick" debris backward and onto the first conveyor belt which carries debris onto the trough. The second conveyor belt is designed to move in a rotational direction same as the forward direction of the trailer which allows the second belt to move debris forward into the main hopper.

Moving from the forward portion (hereinafter the "bow") of the trailer to the rear (hereinafter the "stern"), located behind the hitch assembly is the main trash storage bin or hopper. The reason for the forward location of the hopper is mainly one of balance. As debris collects it gets heavier and the forward location on the trailer avoids unbalanced tipping which could occur if the main storage bin were located towards the rear of the trailer frame.

Situated substantially midway from bow to stern is the rotary drum which is aligned with the two vehicular wheels on the trailer frame. The two vehicular wheels each have a mini-axle which independently mount onto the frame, one on each external, lateral side of the rotary drum. The rotary drum has its own independent axle mounted onto the trailer frame, separate and distinct from the mountings of the mini-axles of the two wheels. This midway location of the drum and alignment with the wheels allows the apparatus to follow the contour of a beach surface Hydraulic jacks, mounted to the frame, lift portions of the trailer in scissor fashion lifting the drum at its axle away from contact with a beach or road surface facilitating transportation after the apparatus has completed its cleaning task.

Located behind the rotary drum is the first conveyor belt which links the path of moving debris from the midway portion of the trailer to the collecting trough. The collecting trough forms the stern of the trailer. In the preferred embodiment, the second conveyor belt is located on the port side, and the second belt links the path of moving debris from the stern portion of the trailer to the main storage hopper located in the bow.

There is a wide possibility of different configurations, arrangements and vehicular design changes which one skilled in the art could adapt to mount the rotary drum with projections and accomplish the same objectives. All these possibilities are included within the spirit of the present invention. Other objects, features and advantages of this invention will become evident in light of the following description of the invention.

DESCRIPTION OF THE PREFERRED EMBODIMENT

Figure 1:
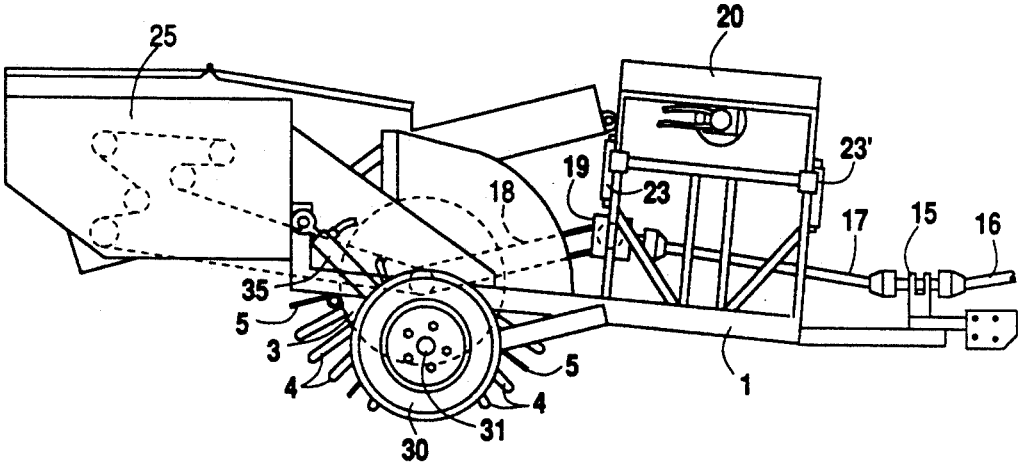
FIG. 1 illustrates a side view of the preferred embodiment. The entire apparatus is shown mounted on a trailer frame.

Referring to FIG. 1, the invention is shown mounted on a trailer frame designated numeral 1. Hitch assembly 15 connects trailer 1 to a tractor (not illustrated) which pulls the trailer. Drive shaft 16 extends from the tractor, through hitch assembly 15, and ultimately forms drive train 17. Drive train 17 powers chain 18 (shown in phantom lines) via gear box 19 Chain 18 powers drum 3 (shown partially in phantom lines) in a counter-clockwise rotation, whereas wheel 30 rotates clockwise when the apparatus is in operation and advancing forward. Means for driving endless conveyor belts is generally designated with the numeral 25 depicted in FIG. 1 with phantom lines.

Located behind hitch assembly 15 is hopper 20. As debris collects within hopper 20, the weight bears down and forward onto hitch assembly 15. When hopper 20 has been filled, hydraulic means 23 and 23' lift hopper 20 onto its side so that debris falls out and into independent collecting means to be hauled away to dump sites.

Situated midway from bow to stern, substantially aligned with wheel 30 is rotary drum 3. Rotary drum 3 has a plurality of rigid projections 5 and a plurality of resilient projections 4. Vehicular wheel 30 has a mini-axle 31 which is independently mounted onto trailer frame 1. Hydraulic jack 35 mounted onto trailer frame 1 lifts drum 3 from contact with a beach or road surface to facilitate transportation after it has completed its cleaning task.

Figure 2:
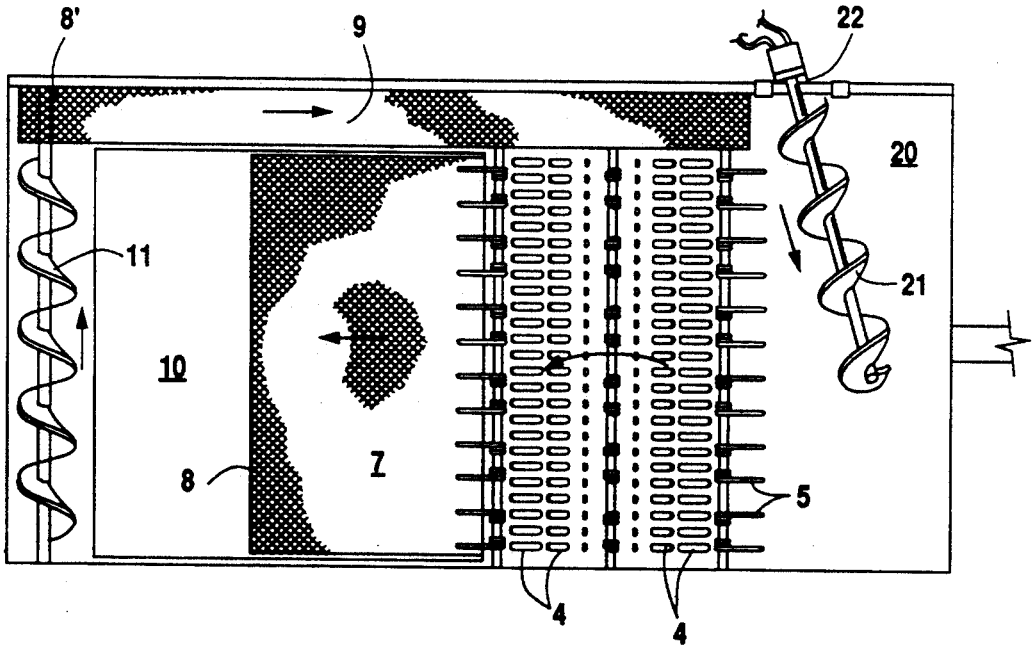
FIG. 2 depicts a top plan view of the preferred embodiment. The path of the moving debris is indicated by arrows. The debris itself is not illustrated.
Figure 4:
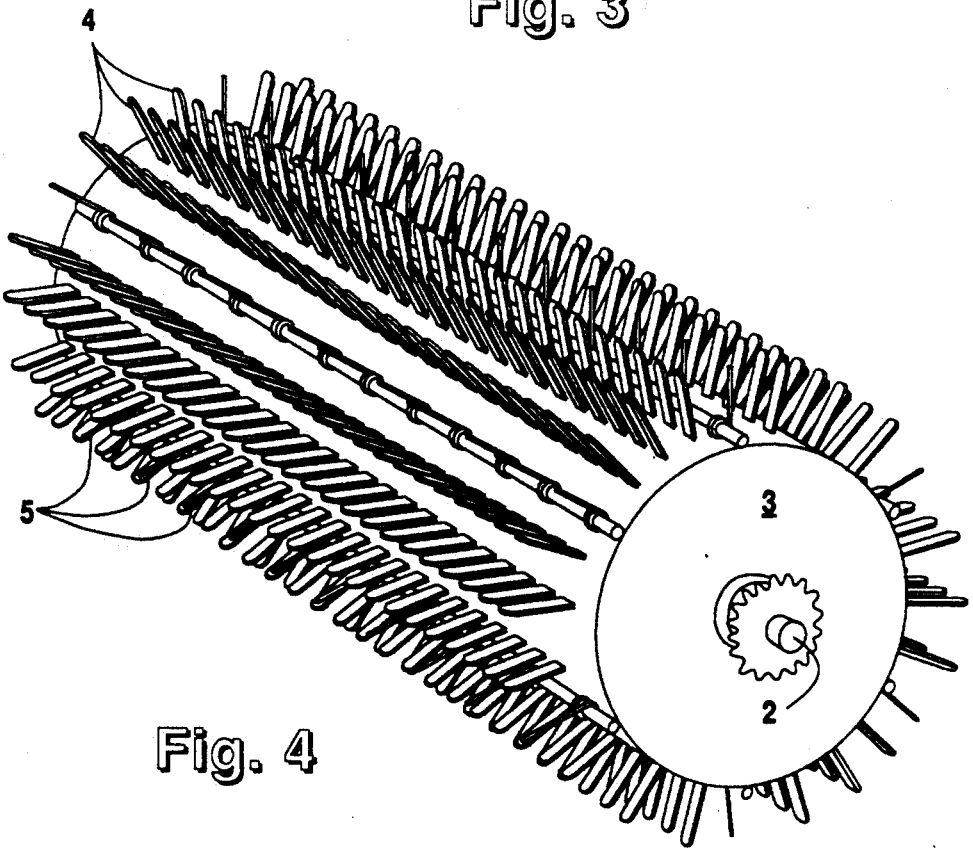
FIG. 4 shows a perspective view of the rotary drum prominently displaying the two types of projections protruding from the drum's surface.

FIG. 2 shows a top plan view of the path of moving debris depicted by arrows. The debris itself is not illustrated. Litter is lifted off a beach surface using plurality of resilient, non-rigid projections 4 mounted on rotary drum 3. The projections are best illustrated in FIG. 4. Referring back to FIG. 2, as the trailer is towed forward, drum 3 rotates counter-clockwise in the opposite rotational direction over a beach surface. Non-rigid projections 4 are sequentially compressed as drum 3 rolls over the sand. As weight comes off the non-rigid projections, they "flick" rearwardly any litter that lies in their path. This rearward flicking motion separates sand from debris as they are tossed onto first, endless conveyor belt 7.

At predetermined intervals, rotary drum 3 has an additional plurality of rigid protrusions 5, separated from non-rigid projections 4. Again, this is best illustrated by FIG. 4. Referring back to FIG. 2, as drum 3 rotates over sand, rigid protrusions 5 dig below the surface and bring up litter which are lodged within the sand. Subsequently, non-rigid projections 4 toss the uncovered trash along with other litter already on the surface onto first endless conveyor belt 7.

First endless conveyor belt 7 is composed of mesh screen material 8. Conveyor belt 7 inclines at an upward angle towards intermediate collecting trough 10. On first conveyor belt 7, any sand that falls off the surface of debris being carried toward trough 10 is sifted to fall back onto the beach through mesh screen material 8. Trough 10 forms the stern of the apparatus and trough 10's curved bottom acts as an intermediate collecting point for the debris. Additionally, trough 10's bottom has linear, striated perforations through which extraneous sand and water which may collect dribble through and fall back onto the beach. Within trough 10, debris is agitated by screw conveyor 11 which rotates and loosens any sand that may have overcome the hurdle of first conveyor belt 7. Screw conveyor 11 then pushes debris onto second conveyor belt 9 which is shown running along the port side of the apparatus. Second belt 9 moves debris toward hopper 20 and any sand loosened by screw conveyor 11 filters through mesh screen material 8 while in transit.

Hopper 20 has a screw auger 21 which is hinged at hinge joint 22 positioned on the same lateral side as second conveyor belt 9. As debris leaves second conveyor belt 9 and moves into hopper 20, auger 21 urges the debris towards the starboard side of hopper 20 avoiding a jam at the point of entry. When hopper 20 is full, hydraulic means 23 (shown in FIG. 1) lifts hopper 20, allowing it to tip over and dump out collected debris. Hinge joint 22 of screw auger 21 allows the auger to hinge freely away so that dumping is not hindered.

Figure 3:
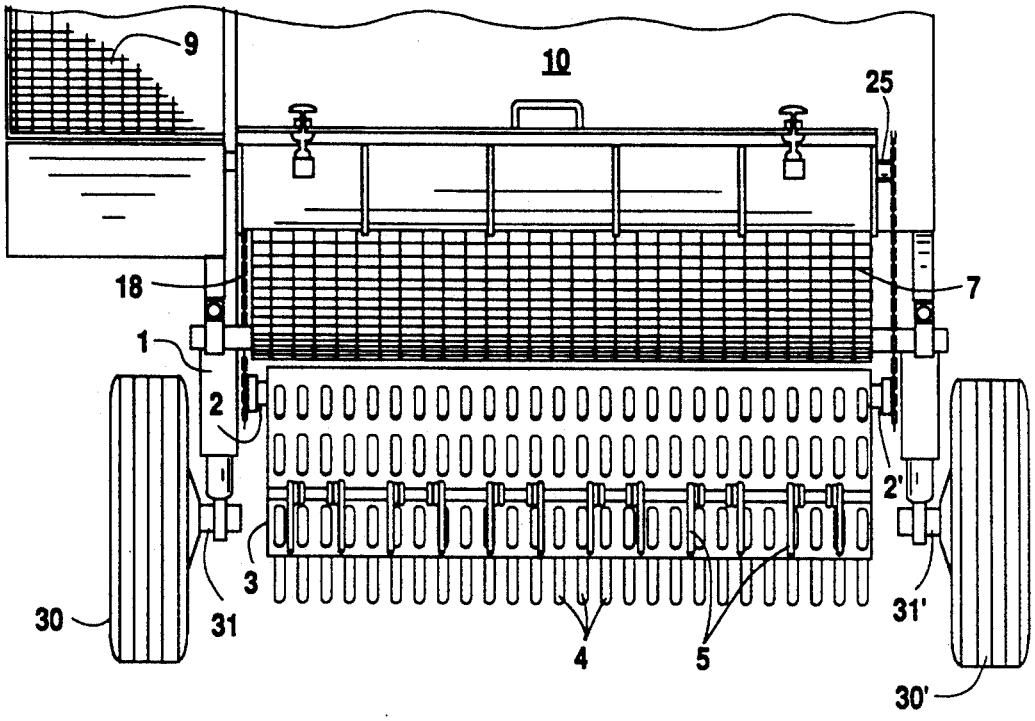
FIG. 3 depicts an end view of the preferred embodiment showing the location of the rotary drum with the projections. The drum is situated between the two wheels on the trailer frame.

FIG. 3 illustrates an end view of the apparatus showing the location of rotary drum 3 in reference to vehicular wheels 30 and 30'. As seen in FIG. 1, wheel 30 is substantially aligned with drum 3 at roughly the midway point from bow to stern on trailer frame 1. Referring back to FIG. 3, vehicular wheel 30' is also aligned with rotary drum 3. Wheels 30 and 30' each have mini-axles 31 and 31' which independently mount onto trailer frame 1. Rotary drum 3 has its own independent axle 2. The midway location of drum 3 and its alignment with wheels 30 and 30' allow drum 3 to follow the rolling contours of a beach surface with the wheels and without becoming an anchor in the sand.

Thus, the present invention is well-suited to carry out the objects and attain the ends and advantages mentioned above as well as those inherent therein. While the preferred embodiments of the present invention have been described for the purposes of this disclosure, changes in the design and arrangements of features can be made by those skilled in the art, which changes are encompassed within the spirit of this invention as defined by the appended claims.

What is claimed is:

1. An apparatus for cleaning litter off a sandy beach, comprising:
   - a vehicular frame;
   - a drum having an axle rotatably mounted on said frame, said drum having a plurality of non-rigid projections and a plurality of rigid nail-like protrusions around the outer surface of said drum;
   - a litter collection bin mounted on said frame;
   - a conveying means connected to said frame located between said drum and said bin; and
   - a means for rotatably driving said axle of said drum such that said plurality of rigid nail-like protrusions provide means for digging up litter embedded in said sandy beach and said plurality of non-rigid projections provide means for tossing litter from said beach onto said conveying means.

2. The apparatus as in claim 1 wherein said vehicular frame has at least two wheels, said drum being substantially aligned with said wheels.

3. The apparatus as in claim 2 wherein said means for rotatably driving said axle rotates said drum in the opposite rotational direction as said wheels when said vehicular frame is in forward motion.

4. The apparatus as in claim 3 wherein said conveying means includes an endless conveyor belt comprised of a perforated material.

5. A sandy beach cleaning apparatus, comprising:
   - a vehicular frame with a front end and a rear end;
   - a drum having an axle rotatably engaged to said frame, said drum having a plurality of non-rigid projections and a plurality of rigid nail-like protrusions around the outer surface of said drum;
   - a collecting trough mounted to said frame at said rear end;
   - a first endless conveyor belt connected to said frame, located between said drum and said trough;
   - a storage bin mounted on said frame at said front end;
   - a second endless conveyor belt connected to said frame, located between said trough and said bin; and
   - a means for simultaneously driving said axle of said drum, said first conveyor belt, and said second conveyor belt such that when said frame is moved in a forward direction, said driving means rotates said drum and said first belt in a rotational direction opposite said forward direction of said frame, and rotates said second conveyor belt in the same rotational direction as said forward direction of said frame.

6. The apparatus as in claim 5 wherein said plurality of rigid nail-like protrusions dig into said sandy beach and remove embedded debris as said drum rotates in said opposite direction to said forward movement of said frame.

7. The apparatus of claim 6 wherein said plurality of non-rigid projections toss up debris lying on said sandy beach onto said first endless conveyor belt as said drum rotates in said opposite direction to said forward movement of said frame.

8. The apparatus as in claim 7 wherein said first endless conveyor belt and said second endless conveyor belt are comprised of a perforated, mesh-screen material.

9. The apparatus as in claim 8 wherein said trough has a screw conveyor mounted on at least one wall of said trough, and has a bottom comprised of linear, striated perforations.

10. The apparatus as in claim 9 wherein said storage bin further comprises:
   - a screw auger mounted on at least one sidewall, said screw auger hinged at a hinge joint on said sidewall;
   - an expanded metal floor; and
   - a means for lifting and tipping said storage bin such that said screw auger hinges free at said hinge joint.

11. The apparatus as in claim 10 wherein an hydraulic means connects said axle of said drum to said frame, said hydraulic means raises said drum when said apparatus is in a non beach-cleaning mode.

* * * * *